US005873962A

United States Patent [19]

Kaneko et al.

[11] Patent Number: 5,873,962

[45] Date of Patent: Feb. 23, 1999

[54] TIRE HAVING CORROSION RESISTANT STEEL CORD

[75] Inventors: Yoshikazu Kaneko; Naohiko Obana, both of Tochigi-ken, Japan

[73] Assignee: Bridgestone Metalpha Corporation, Tochigi-ken, Japan

[21] Appl. No.: 769,572

[22] Filed: Dec. 19, 1996

Related U.S. Application Data

[62] Division of Ser. No. 652,082, May 23, 1996.

[30] Foreign Application Priority Data

| | | | |
|---|---|---|---|
| May 26, 1995 | [JP] | Japan | 7-152638 |
| Oct. 3, 1995 | [JP] | Japan | 7-282538 |
| Oct. 17, 1995 | [JP] | Japan | 7-304934 |
| Nov. 17, 1995 | [JP] | Japan | 7-324006 |
| Nov. 17, 1995 | [JP] | Japan | 7-324007 |

[51] Int. Cl.[6] ..... B60C 9/00; B60C 9/04

[52] U.S. Cl. ..... 152/556; 152/451

[58] Field of Search ..... 216/100, 108, 216/52–53; 57/902, 9, 311, 206, 212, 213, 216, 236, 237; 152/451, 527, 556

[56] References Cited

U.S. PATENT DOCUMENTS

| | | | |
|---|---|---|---|
| 4,481,996 | 11/1984 | De Bondt et al. | 57/902 X |
| 4,938,015 | 7/1990 | Kinoshita | 152/556 X |
| 5,236,029 | 8/1993 | Nakashio et al. | 152/451 |

FOREIGN PATENT DOCUMENTS

| | | |
|---|---|---|
| 57-149578 | 9/1982 | Japan . |
| 3-104821 | 5/1991 | Japan . |
| 4-126605 | 4/1992 | Japan . |

*Primary Examiner*—Adrienne Johnstone
*Attorney, Agent, or Firm*—Jordan and Hamburg LLP

[57] ABSTRACT

A steel cord intended for use to reinforce rubber products is produced by drawing, into a steel filament of 0.10 to 0.40 mm in diameter and more than 3,000 N/mm$^2$ in strength, a wire rod having a carbon content of more than 0.70% by weight, and twisting a plurality of such steel filaments together. Also a pneumatic tire is provided which employs in at least a portion of a reinforcing member thereof the steel cord improved in corrosion resistance and having an $R_1/R_0$ ratio ×100 which is less than 100, where $R_0$ is the radius of spiral curvature of the spiraled steel filament resulting from untwisting said steel cord and $R_1$ is the radius of spiral curvature of said steel filament of which the surface layer inside the spiral is removed by dissolving.

10 Claims, 11 Drawing Sheets

TIRE HAVING CORROSION RESISTANT STEEL CORD

This is a division of application Ser. No. 08/652,082, filed May 23, 1996, pending.

BACKGROUND OF THE INVENTION

1. Field of the Invention

The present invention relates to a tire reinforcing steel cord and a pneumatic tire using the steel cord, and more particularly to a steel cord destined to reinforce the carcass and belt of a pneumatic tire and having a reduced weight and improved durability, and a pneumatic tire using the steel cord.

2. Description of the Prior Art

These days, a best possible gas mileage of the wheeled motor vehicles has been advocated for environmental protection of the earth. To this end, such vehicles are required to be as light as possible and thus the wheel tires should also be lighter. It has been tried in this field of industry to reduce the amount of steel cord used to reinforce the tire without making the sacrifice of the tire strength by improving the strength of the steel cord. Also, however, it is well-known that increase in tensile strength per unit sectional area of steel filaments forming together a steel cord will deteriorate the resistance to fatigue of the steel cord.

To improve the tire's resistance to fatigue, some proposals have so far been made in the field of industry. A typical one of them is disclosed in the Japanese Unexamined Patent Publication No. (Heisei) 5-71084. According to this reference, a steel wire is manufactured by plating high-carbon steel filaments of which the carbon content is more than 0.6%, drawing them and using drawing dies of less than 8 degrees in approach angle at the end of the drawing process to reduce the axial residual tensile stress in the wire surface layer to less than 45 kg/mm$^2$ as measured by the X-ray diffraction method.

However, this solution is not advantageous for the following reasons. Namely, straight steel filaments being twisted together are plastically deformed, causing a corresponding residual tensile stress in the surface layer inside the axis of the spiraled steel filaments which would result from untwisting of the steel cord, so that the steel cord thus obtained will not have so much improved resistance to corrosion fatigue.

Further, the Japanese Unexamined Patent Publication No. (Showa) 57-149578 discloses a metal wire which is said to have an improved mechanical-fatigue resistance attainable by compressing and evenly dispersing the residual stress in the outer surface layer. To improve the resistance to corrosion fatigue, this reference also proposes to use an alloy wire containing, as added thereto, an element which will impart an corrosion resistance to the wire rod for an intended steel cord, or to penetrate rubber into the steel cord in order to inhibit contact of the steel filaments with water.

However, since the steel cord is processed for a residual compressive stress to be imparted mainly to all the outer circumference of the steel cord, so the residual compressive stress will be caused mainly in the surface layer outside the spiral of the steel filaments. Thus the steel cord will not have the corrosion-fatigue resistance improved so much as expected at the depth thereof to which rubber cannot be easily penetrated. This is because no flyer processing of the steel cord is required after spiraling the steel filaments has caused at the outer surface thereof a sufficient residual compressive stress for a corrosion-fatigue resistance.

Penetration of rubber into the steel cord to prevent the steel filaments from getting in contact with water cannot effectively improve the corrosion resistance of the steel cord unless the rubber penetration is sufficient. Even if the rubber could be penetrated in a sufficient amount into the steel cord, a void or voids takes place in the boundary between the steel filaments and rubber unless the rubber is sufficiently adherent to the steel filaments. Such void or voids deteriorate the corrosion resistance of the steel cord.

On the other hand, the addition of the element which imparts a corrosion resistance to the wire rod will lead to increased manufacturing costs of the wire rod and deteriorate the elongation of the wire rod.

Furthermore, the Japanese Unexamined Patent Publication No. (Heisei) 3-104821 also discloses a method of producing a highly strong, high-ductility thin steel wire. According to this reference, a wet continuous drawing process is employed in which an increased number of drawing posts each using a die of which the taper angle is reduced to limit heat buildup in the process of drawing. However, this method is not advantageous in the low efficiency of drawing work.

Also the Japanese Unexamined Patent Publication No. (Heisei) 4-126605 discloses a method of designing a lighter tire without making the sacrifice of the tire durability, in which a steel cord made of a carbon steel containing carbon in 0.90 to 0.95% by weight and chromium in 0.10 to 0.40% by weight is used to reinforce the tire. A reduction of tire weight may be attained by using a reduced amount of wire rod for the steel rod, but there is a possibility that the tire durability may be correspondingly lower. Such selection of a carbon steel containing special ingredients will add to the manufacturing costs of the steel cord.

The conventional pneumatic tires for use with trucks and buses use as the carcass thereof a steel cord made of steel filaments each of 2,750 to 3,150N/mmn$^2$ in tensile strength and formed in a two-layer twisted structure (3+9×0.23+1) or a three-layer twisted structure (3+9+1.5×0.175+1). However, if the steel cord is desired to have a structure of 3+9×0.21 in which the thinner steel cord is used to reduce the total weight of the tire, the number of steel cords encased in the carcass ply in the tire has to be increased to maintain the tire strength. As a result, the spacing between the steel cords in the carcass is too narrow, which causes the return end of the carcass ply to be broken more easily.

The tire is likely to be bruised deeply to near the steel cord by any projection on the surface or side wall of the road from time to time. Water may invade through the bruise into the tire and corrode the steel filaments, which will deteriorate the tire durability.

Further, a method also has been proposed in which the number of steel filaments forming the outer layer of a tire is reduced for a deeper penetration of rubber into the steel cord in order to prevent the steel filaments from being corroded. However, this method cannot attain any satisfactory effect unless the rubber is penetrated sufficiently deep into the steel cord. Even if the rubber is penetrated deeply, water the rubber itself contains will spoil the resistance of the steel filaments to corrosion fatigue.

SUMMARY OF THE PRESENT INVENTION

As having been described in the foregoing, it is widely known in the field of industry that increasing the strength of the steel filaments in a steel cord having the aforementioned structure will lower the corrosion-fatigue resistance. However, the present invention was worked out based on the Inventor's finding that an improved corrosion-fatigue resistance of a high-strength steel filament can be attained by reducing the residual tensile stress in the surface layer inside the spiral of the steel filaments.

According to the present invention, the carbon content in steel filaments of a steel cord destined for reinforcement of a rubber product is more than 0.7% by weight for the steel filaments need to have a strength of more than 3,000N/mm$^2$ in order to lighten the rubber product in which the steel cord is used.

Also, according to the present invention, the diameter of the steel filament is within a range of 0.10 mm to 0.40 mm because the work efficiency of drawing is lower with a filament diameter below 0.10 mm while the resistance to mechanical fatigue of the steel filament is lower with a filament diameter above 0.40 mm.

When untwisted, the steel cord will be a plurality of spiraled steel filaments because straight steel filaments for a steel cord are plastically deformed while being twisted.

BRIEF DESCRIPTION OF THE DRAWINGS

The manner in which the objects mentioned above and other objects of the invention are achieved will be evident in the more detailed description of preferred embodiments of the invention which will now be set forth in reference to the drawings.

DETAILED DESCRIPTION OF THE PREFERRED EMBODIMENTS

The first embodiment of steel cord according to the present invention will be described herebelow:

According to this embodiment, a 5.5 mm-diameter wire rod made of a plain carbon steel containing as ingredients C in 0.81% by weight, Si in 0.23%, Mn in 0.48%, P in 0.006% and S in 0.008% was dry-drawn to a desired diameter, and then was patented and brass-plated. The wire rod thus processed was wet-drawn to an actual distortion of 3.8 to thereby produce a steel filament of 0.21 mm in diameter and 3,695N/mm$^2$ in tensile strength. During this process, the steel filament drawn should desirably be repeatedly bent, while being tensioned, to reduce the residual tensile stress in the steel filament surface.

The steel filaments thus obtained are twisted together into a steel cord in the conventional manner by means of a tubular twisting machine According to the present invention, the steel cord was tensioned while being passed through between straightening rollers to reduce the residual tensile stress in the surface layer inside the spiral of the steel filaments in the steel cord. A steel cord having a "3+8×0.21 mm" configuration, for example, was tensioned with a force of 450N/cord to reduce the residual tensile strength. The twisting machine it not limited to the tubular type, but a buncher type twisting machine may be used for this purpose.

Figure 3:
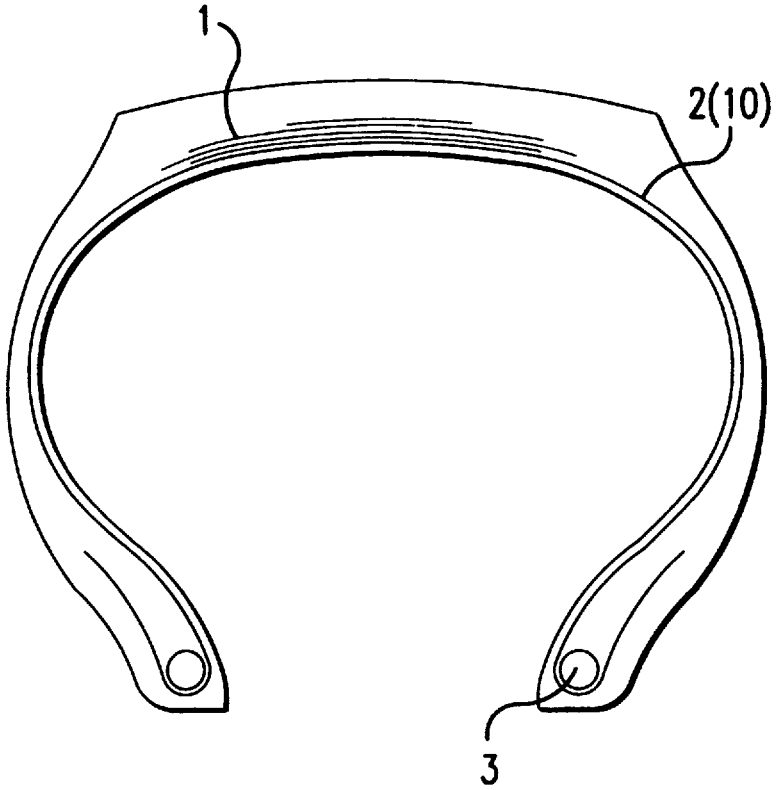
FIG. 3 is a sectional view of a pneumatic tire.

A tire using, as encased in the carcass ply thereof, the steel cord according to the present invention was experimentally built. FIG. 3 is a sectional view of such an experimentally built pneumatic tire. As shown, the pneumatic tire consists of a belt 1, carcass 2, and beads 3. The size of this tire was 11R22.5-14PR and the number of steel cords encased in the carcass ply was 31.5 per 5 cm.

Figure 1:
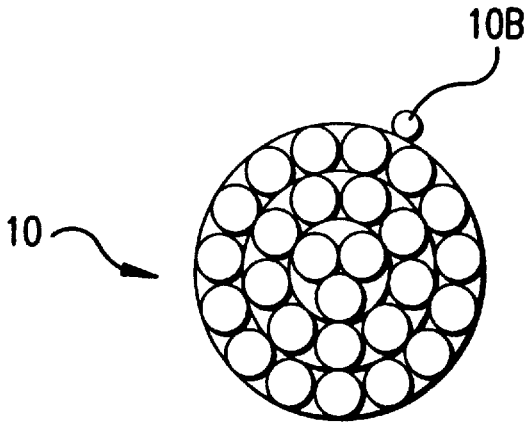
FIG.1 (PRIOR ART)
FIG. 1 is a sectional view of a steel cord having a conventional structure comprising 3+9+15+1 steel filaments.
Figure 2:
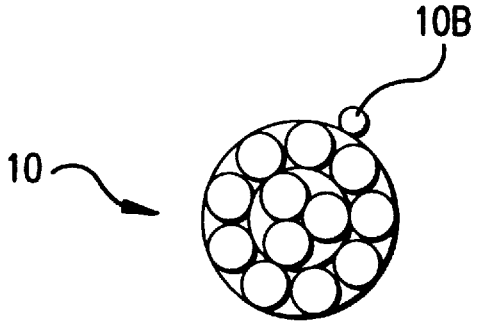
FIG.2 (PRIOR ART)
FIG. 2 is a sectional view of a steel cord having a conventional "3+9+1" configuration.

The properties of the steel cord and experimental tire produced according to the present invention are shown in Tables 1 through 3. In Table 1, the conventional steel cord 1 has the structure shown in FIG. 1, the comparative example 1 has a "3+9+15" configuration and the embodiments A through F according to the present invention have the structures shown in FIGS. 8 through 13, respectively. In Table 2, the conventional steel cord 2 has the structure shown in FIG. 2, the comparative example 2 has a "3+9" configuration and the embodiments G through G according to the present invention have the configurations shown in FIGS. 7 through 12, respectively. In Table 3, the conventional steel cord 3 has the configuration shown in FIG. 2, the comparative example 3 also has the configuration shown in FIG. 2 and the embodiments M through Q according to the present invention have the configurations shown in FIGS. 6 through 10, respectively.

TABLE 1

| | Conventional steel cord 1 | Comparative example 1 | Embodiment A | Embodiment B |
|---|---|---|---|---|
| Steel cord configuration | 3 + 9 + 15 × 0.175 + 0.15 | 3 + 9 + 15 × 0.16 | 3 + 8 × 0.245 | 4 + 9 × 0.21 |
| Twisted direction | S/S/Z/S | S/S/Z | S/S | S/S |
| Pitch (mm) | 5.5/10.5/15.5/3.5 | 5.5/10.5/15.5 | 6.0/12.0 | 5.5/11.0 |
| Filament tensile strength ($N/mm^2$) | 2860 | 2860 | 3450 | 3840 |
| Inter-cord spacing (mm) | 0.74 | 0.53 | 0.73 | 0.76 |
| Amount of steel cord used(%) | 100 | 97.3 | 80.7 | 72.4 |
| *1 | 108 | 104 | 91 | 88 |
| Rubber penetration | X | X | ○ | ○ |
| Breaking-load retention (%) | 75 | 84 | 93 | 94 |
| Corrosion-fatigue resistance | 100 | 112 | 179 | 202 |
| | Embodiment C | Embodiment D | Embodiment E | Embodiment F |
| Steel cord configuration | 1 + 5 + 10 × 0.195 | 2 + 7 + 12 × 0.18 | 3 + 8 + 13 × 0.155 | 4 + 9 + 14 × 0.15 |
| Twisted direction | −/S/S | S/S/Z | S/S/Z | S/S/Z |
| Pitch (mm) | −/5.5/11.0 | 5.0/10.0/15.0 | 5.0/10.0/15.0 | 5.0/10.0/15.0 |
| Filament tensile strength ($N/mm^2$) | 3705 | 3575 | 3870 | 3715 |
| Inter-cord spacing (mm) | 0.75 | 0.79 | 0.76 | 0.77 |
| Amount of steel cord used(%) | 75.1 | 77.8 | 71.9 | 74.9 |
| *1 | 93 | 90 | 89 | 92 |
| Rubber penetration | ○ | ◎ | ○ | ○ |
| Breaking-load retention (%) | 92 | 96 | 95 | 93 |
| corrosion-fatigue resistance | 178 | 198 | 186 | 171 |

*Curvature change at depth equivalent to 3% of filament diameter from cord surface (%)

TABLE 2

| | Conventional steel cord 2 | Comparative example 2 | Embodiment G | Embodiment H |
|---|---|---|---|---|
| Steel cord configuration | 3 + 9 × 0.23 + 0.15 | 3 + 9 × 0.21 | 2 + 7 × 0.235 | 3 + 8 × 0.21 |
| Twisted direction | S/S/Z | S/S | S/S | S/S |
| Pitch (mm) | 6.0/12.0/3.5 | 5.5/11.0 | 6.0/12.0 | 5.5/11.0 |
| Filament tensile strength($N/mm^2$) | 2920 | 2920 | 3775 | 3695 |
| Inter-cord spacing (mm) | 0.70 | 0.51 | 0.78 | 0.73 |
| Amount of steel cord used(%) | 100 | 96.5 | 74.7 | 76.3 |
| *1 | 105 | 101 | 92 | 90 |
| Rubber penetration | X | X | ◎ | ○ |
| Breaking-load retention (%) | 78 | 82 | 94 | 95 |
| Corrosion-fatigue resistance | 100 | 113 | 171 | 164 |
| | Embodiment I | Embodiment J | Embodiment K | Embodiment L |
| Steel cord configuration | 4 + 9 × 0.195 | 1 + 5 + 10 × 0.17 | 2 + 7 + 12 × 0.16 | 3 + 8 + 13 × 0.15 |
| Twisted direction | S/S | −/S/S | S/S/Z | S/S/Z |
| Pitch (mm) | 5.5/11.0 | −/5.0/10.0 | 5.0/10.0/15.0 | 5.0/10.0/15.0 |
| Filament tensile strength($N/mm^2$) | 3555 | 3870 | 3575 | 3715 |
| Inter-cord spacing (mm) | 0.71 | 0.75 | 0.76 | 0.87 |
| Amount of steel cord used(%) | 79.2 | 72.8 | 78.8 | 75.9 |
| *1 | 91 | 93 | 88 | 87 |
| Rubber penetration | ○ | ◎ | ◎ | ○ |
| Breaking-load retention (%) | 92 | 93 | 96 | 93 |
| Corrosion-fatigue resistance | 168 | 173 | 197 | 193 |

*1: Curvature change at depth equivalent to 3% of filament diameter from cord surface (%)

TABLE 3

| | Conventional steel cord 3 | Comparative example 3 | Embodiment M | Embodiment N |
|---|---|---|---|---|
| Steel cord configuration | 3 + 9 × 0.19 + 0.15 | 3 + 9 × 0.175 + 0.15 | 1 + 5 × 0.23 | 2 + 7 × 0.20 |
| Twisted direction | S/S/Z | S/S/Z | −/S | S/S |
| Pitch (mm) | 6.0/8.0/3.5 | 5.5/10.5/3.5 | −/6.0 | 5.5/11.0 |
| Filament tensile strength($N/mm^2$) | 2970 | 2950 | 3780 | 3705 |
| Inter-cord spacing (mm) | 0.73 | 0.55 | 0.73 | 0.78 |

TABLE 3-continued

| | | | | |
|---|---|---|---|---|
| Amount of steel cord used(%) | 100 | 101.6 | 74.7 | 76.3 |
| *1 | 112 | 110 | 92 | 88 |
| Rubber penetration | X | X | ◎ | ◎ |
| Breaking-load retention(%) | 79 | 80 | 92 | 94 |
| Corrosion-fatigue resistance | 100 | 106 | 204 | 243 |

| | Embodiment O | Embodiment P | Embodiment Q |
|---|---|---|---|
| Steel cord configuration | 3 + 8 × 0.18 | 4 + 9 × 0.155 | 1 + 5 + 10 × 0.15 |
| Twisted direction | S/S | S/S | −/S/S |
| Pitch (mm) | 5.0/10.0 | 5.0/10.0 | −/5.0/10.0 |
| Filament tensile strength(N/mm$^2$) | 3575 | 3870 | 3715 |
| Inter-cord spacing (mm) | 0.76 | 0.74 | 0.83 |
| Amount of steel cord used(%) | 79.0 | 73.0 | 76.1 |
| *1 | 90 | 94 | 93 |
| Rubber penetration | ○ | ○ | ◎ |
| Breaking-load retention(%) | 9.5 | 93 | 96 |
| Corrosion-fatigue resistance | 204 | 179 | 201 |

*1: Curvature change at depth equivalent to 3% of filament diameter from cord surface (%)

The "inter-cord spacing" was measured at the return points of the steel cords 10 encased in the carcass 2 (the steel cords in the carcass will be referred to as "carcass cord" hereinafter) near the beads 3 of the tire. The "amount of steel cord used" is assumed to be 100 for the conventional steel cords. It indicates exponentially the weight of the carcass cord 10 in each of the tires tested. The smaller figure means a lighter tire.

For testing the "curvature change at depth equivalent to 3% of filament diameter from surface", the following preparation was made. Namely, one of the carcass cords 10 in the tire was sampled, and untwisted into spiraled steel laments 10A (as in FIG. 4). One (10A') was sampled from those steel filaments 10A, which form the outermost layer (sheath), cut to a length of 100 mm, enameled longitudinally and semi-circumferentially thereof, and then immersed in a 50% aqueous nitric acid. The movement of the steel filament 10A was measured when the other half not enameled of the filament circumference dissolved to a depth equivalent to 3% of the filament diameter.

Figure 4:
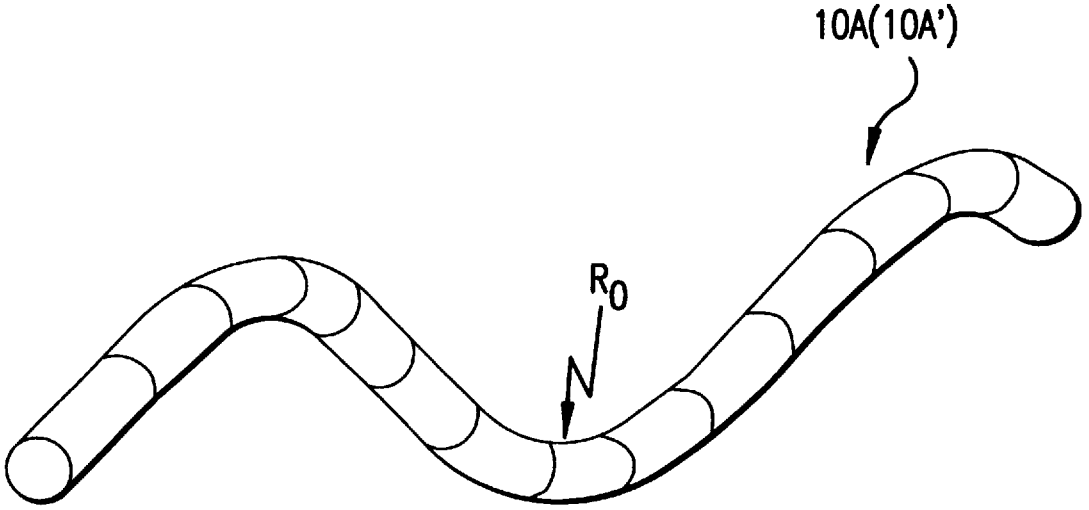
FIG. 4 is an explanatory drawing showing the spiral shape of the steel filaments when the steel cord is untwisted.
Figure 5:
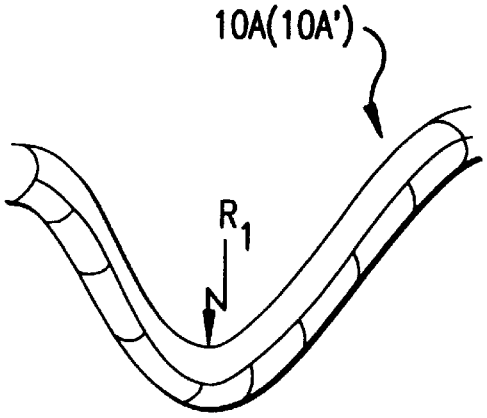
FIG. 5 is an explanatory drawing showing the spiraled steel filament, resulting from untwisting of the steel cord, the surface layer inside the spiral thereof having been dissolved away.
Figure 6:
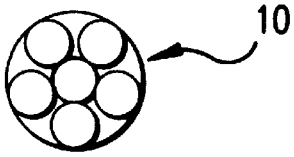
FIG. 6 is a sectional view of a steel cord having a "1+5" configuration according to the present invention.
Figure 7:
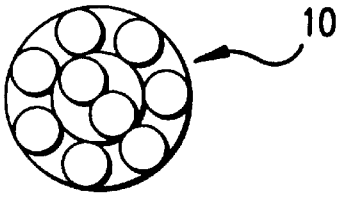
FIG. 7 is a sectional view of a steel cord having a "2+7" configuration according to the present invention.
Figure 8:
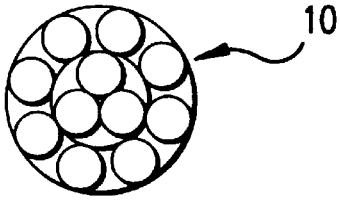
FIG. 8 is a sectional view of a steel cord having a "3+8" configuration according to the present invention.
Figure 9:
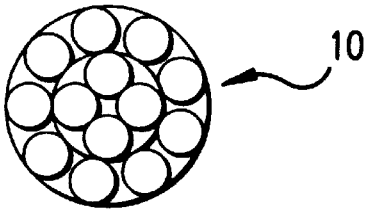
FIG. 9 is a sectional view of a steel cord having a "4+9" configuration according to the present invention.
Figure 10:
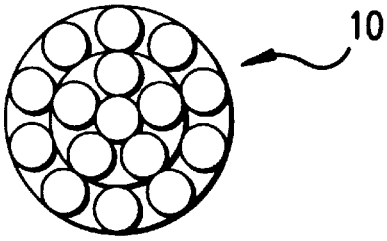
FIG. 10 is a sectional view of a steel cord having a "1+5+10" configuration according to the present invention.
Figure 11:
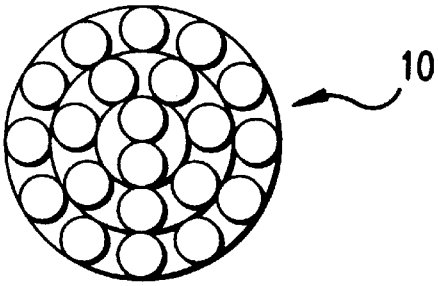
FIG. 11 is a sectional view of a steel cord having a "2+7+12" configuration according to the present invention.
Figure 12:
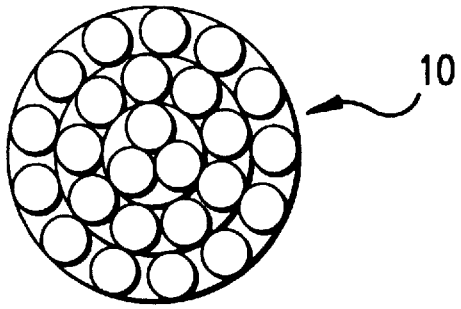
FIG. 12 is a sectional view of a steel cord having a "3+8+13" configuration according to the present invention.
Figure 13:
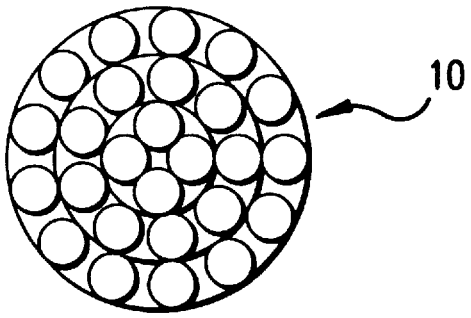
FIG. 13 is a sectional view of a steel cord having a "4+9+14" configuration according to the present invention.

The steel filament thus measured is shown in FIGS. 4 and 5. The radius (in mm) of spiral curvature of the steel filament 10A' of which the surface layer inside the spiral was not yet removed by dissolving is indicated with $R_0$ while that of the steel filament 10A' of which the surface layer inside the spiral was removed is indicated with $R_1$.

For testing the "rubber penetration", one of the carcass cords 10 in the tire was taken as a sample, and the coverage of the rubber on the core over the entire length of the carcass cord 10 was measured. In Tables, the small double circle (◎) indicates a coverage of 90 to 100%, small circle (○) indicates a coverage of 80 to 89%, and the cross ( x ) indicates a coverage of 79% or less. A rubber coverage of 80% or more will not lead to any practical inconvenience.

The "breaking-load retention" was measured through a drum test of each tire under test. After the tire was driven to roll on a drum over a distance of 200,000 km under an internal pneumatic pressure and load as prescribed in the Japanese Industrial Standard, the carcass cords were sampled from the tire carcass, and the breaking load or strength of the sample was measured for comparison with that of the carcass cord sampled from a tire not subjected to this test driving to see how much the breaking strength changed after such tire driving. Thus the breaking-load retention is indicated with a ratio of the breaking strength of the cars cord of the tire not subject to this driving with that of the carcass cord sample from the tire subjected to the driving.

For testing the "corrosion-fatigue resistance", the following preparation was made. Before fitting the tire under test to the rim of a wheel, a tire tube was placed inside the inner liner of the tire, and 300 ml of water was put as sealed between the inner liner and tube. Similarly to the breaking-load retention test, the tire was driven to roll on the drum under the normal internal pneumatic pressure and normal load as prescribed in the, Japanese Industrial. Standard. The tire rolling was continued until the carcass cord was broken up (CBU). Then the rolling or driving distance (tire's life) of the tire was measured. The driving distance of the conventional tires was assumed to be 100. Therefore, the corrosion-fatigue resistance exponentially indicates the measured driving distance of the tire. A larger exponent indicates a better resistance to corrosion fatigue of the tire.

The tire reinforcing steel cord 10 according to the first embodiment of the present invention will be described in further detail herebelow.

The carbon content in the carbon steel for the steel cord 10 according to the present invention has previously been described to be more than 0.70% by weight. This carbon content aims at a tensile strength of the steel filament 10A ranging from 3,400 to 3,900N/mm$^{2.}$ Preferably it should be limited to less than 0.85% by weight for a proeutectoid cementite to be limited from taking place during patenting, thereby ensuring the ductility of the steel filament. For lower manufacturing costs, the carbon steel should preferably be a plain carbon scrap in the present invention.

Also, according to the present invention, the diameter of the steel filament 10A is within a range of 0.15 to 0.25 mm. There are some reasons for this limitation. Namely, a diameter of less than 0.15 mm will increase the tensile strength of the steel filament but lower the efficiency of drawing. This is an economic drawback in the field of industry. On the other hand, if the diameter is larger than 0.25 mm, the steel filaments will show only a poor resistance to repeated bending fatigue of the steel cord 10 and also cause the steel cord 10 to have too great a flexural rigidity, which makes it difficult to, form a tire, especially the beads 3 thereof.

Further, the tensile strength of the steel filament 10A was measured. A tensile strength of less than 3,400N/mm$^2$ is not large enough to maintain the breaking strength of the steel cord and to provide a lighter tire without making the sacrifice of the tire strength but a one of more than 3,900 N/mm$^2$ will possibly lower the drawing efficiency and the ductility of the steel filament 10A, which will limit the possible frequency of tire retreading.

According to the present invention, the steel filaments as the core and sheath may be of different diameters (these filaments will be referred to as "core filaments" and "sheath filaments", respectively, hereinafter). However, a same diameter of both the core and sheath filaments will make it possible to manufacture the steel cords at a high productivity.

Also, the present invention provides a two-layer twisted steel cord comprising a number M (M=1 through 4) of core filaments and a number N (N =M+(2 through 5)) of sheath filaments or a three-layer twisted steel cord having a number N+(2 through 5) of steel filaments disposed around the two-layer twisted steel cord. Such configurations of the steel cord are intended to provide a twisted structure of steel cord which enables a satisfactory rubber penetration but is not disadvantageous for the resistance to fatigue, and also to improve the filling rate of steel filaments in the steel cord cross-section in order to provide a necessary breaking strength of the cord strength while the steel cord diameter is as small as possible. Therefore, the number of core filaments should preferably be one or two with which no internal space is defined or three with which the internal space defined between them is small.

Figure 14A:
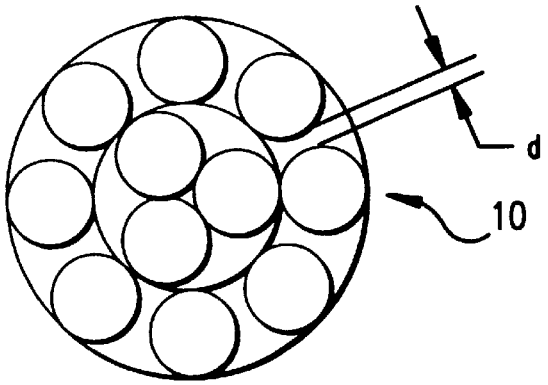
FIGS. 14(A) and 14(B) are sectional views showing the spacings between the steel filaments in the steel cords.
Figure 14B:
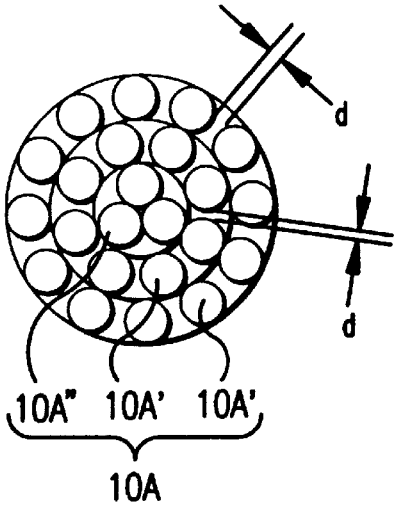

FIGS. 14(A) and 14(B) are sectional views of steel cords according to the present invention, showing the inter-filament spacings in the steel cords. In these Figures, a mean value d of the spacing between the adjacent steel filaments 10A' forming together a sheath (generically indicates all sheaths wound on the outer circumference except for the outer circumference of the core) is equal to or larger than 0.02 (mm) and equal to or smaller than the filament diameter ×1.5 (mm). When the mean value d is smaller than 0.02 mm, it is difficult to penetrate rubber deep into the steel cord to near the core during tire vulcanization. If the mean value A exceeds the filament diameter ×1.5, the sheath filaments 10A' are irregularly disposed, causing the fatigue resistance of the steel cord to be lower, and the filling rate of the steel filaments 10A' inside the cross-sectional circle circumscribing the steel cord 10 is low, causing the steel cord 10 to have an insufficient breaking strength or the steel cord diameter to be large, so that the composite of the steel cord and rubber has an increased thickness, which will be not advantageous for a lighter tire design.

Figure 18:
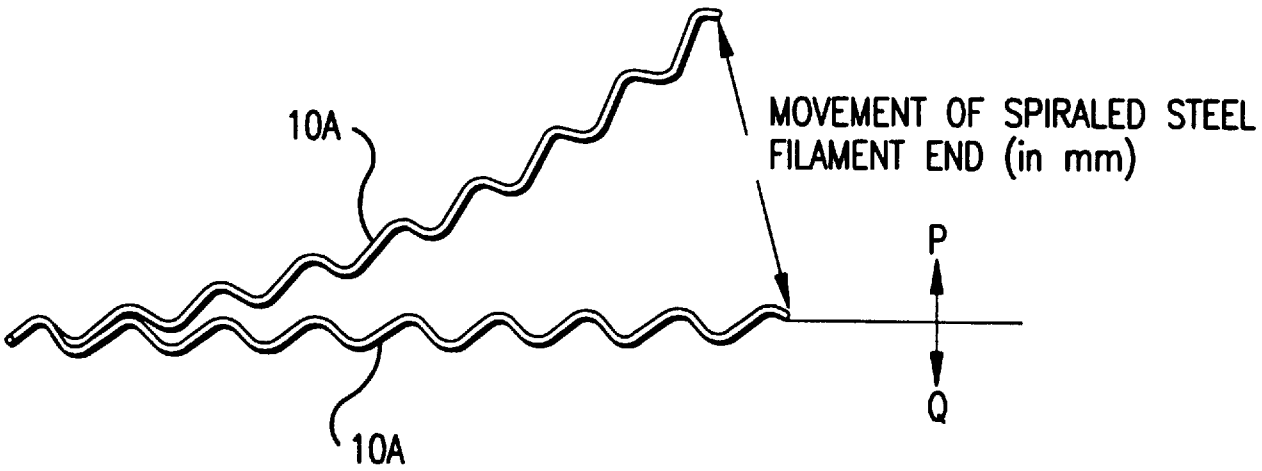
FIG. 18 shows a distance over which the end of a 100 mm-long spiraled steel filament resulting from untwisting the steel cord moves.
Figure 19:
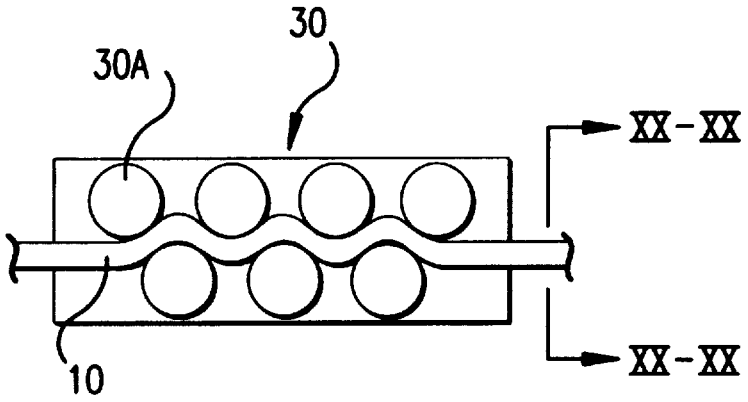
FIG. 19 shows the portion of the steel cord in which the residual stress is reduced by repeatedly bending the steel cord.
Figure 20:
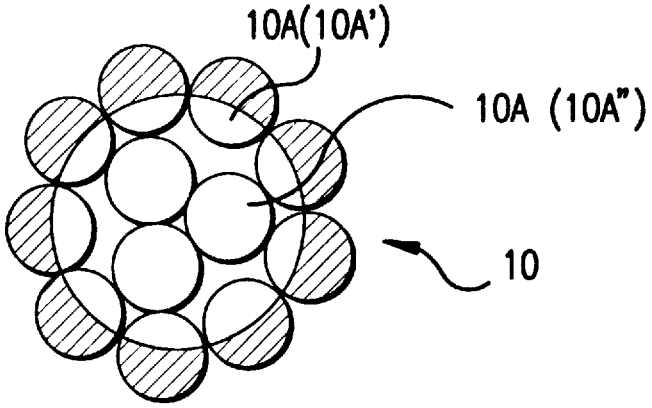
FIG. 20 is a sectional view taken along the line XX—XX in FIG. 19.

Untwisting the steel cord 10 will result in a plurality of spiraled steel filaments 10A as shown in FIG. 18 because straight steel filaments being twisted together into the steel cord 10 are plastically deformed. This fact has proved that even if a residual tensile stress in the surface layer of the steel filaments is reduced in the process of drawing, a maximum residual tensile stress takes place inside the spiral of the steel filaments, causing the corrosion-fatigue resistance to be lower. Accordingly, the present invention is based on the above-mentioned fact to improve the steel cord's resistance to corrosion fatigue by reducing the tensile stress in the surface layer inside the spiral of the steel filaments formed together into a steel cord.

When a vehicle with steel cord-reinforced tires fitted to the wheel rims runs, the tires are repeatedly bent and thus the steel filaments of the steel cord so frictionally abrade with each other (fretting) as to be likely to be corrosion-fatigued. Therefore, the tensile stress residing in a range from the surface of the steel filament to a depth equivalent to 5% of the filament diameter should preferably be reduced, and it is more preferably to reduce the residual tensile stress within a range from the surface to a depth equivalent to 10% of the filament diameter.

According to the present invention, the sheath filaments are preformed at a rate of 80 to 110%. This preforming rate is a ratio between the theoretical spiral diameter of steel filaments completed in a steel cord and the spiral diameter of steel filaments resulting from untwisting the steel cord. If the preforming rate P is less than 80%, the sheath filaments abrade each other more heavily (fretting), so he breaking strength of the steel cord is lowered as the tire is used for a long time. On the other hand, if the preforming rate exceeds 110%, the sheath filaments cannot be regularly disposed so that the fatigue resistance is lowered and the steel cord has a larger diameter (the composite of steel cord and rubber will have an increased thickness), which is disadvantageous for designing of lighter tires.

Figure 21:
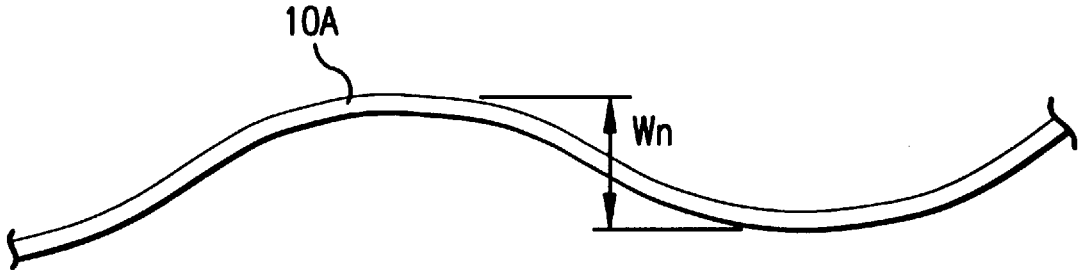
FIG. 21 is a side elevation of an untwisted steel filament prepared for explanation of the sheath filament preforming.
Figure 22:
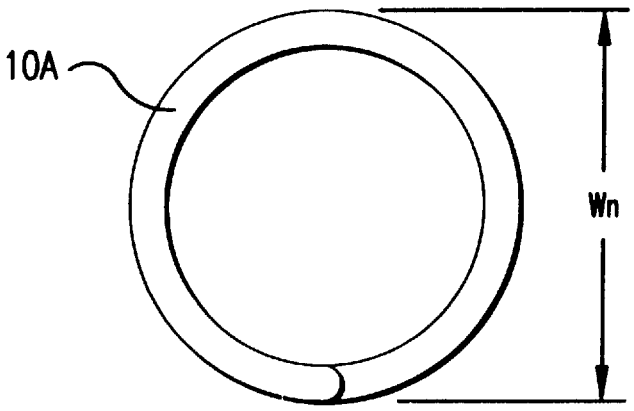
FIG. 22 is a front view of the steel filament in FIG. 21.

The preforming rate Pn of steel filaments forming together a n-th sheath layer is given as follows:

$$\begin{aligned} Pn &= (Wn/Dn) \times 100 \\ &= 100Wn/[d(2n + 1 + 1/\sin(\pi/Nn)] \end{aligned}$$

where Wn: Measured spiral diameter of the steel filament 10A in the n-th sheath layer shown in FIGS. 21 and 22

Dn: Theoretical spiral diameter of the n-th sheath (sheath diameter) (Dn=Do+2nd) when completed in a steel cord Do: Core diameter (Do=d+d/sin (2π/2Nn))

d: Steel filament diameter

Nn: Number of steel filaments of the n-th sheath.

The present invention does not use the one wrapping wire 10B (see FIGS. 1 and 2) wound on the outermost layer of the conventional steel cord 10 to prevent the sheath filaments 10A' from being fretted by such wrapping wire 10B. Therefore, it is possible to minimize the deterioration of the steel cord's breaking strength even after the tire has been used for a long time, and the steel cord can have a smaller diameter, which will be advantageous for lighter tires.

Figure 15:
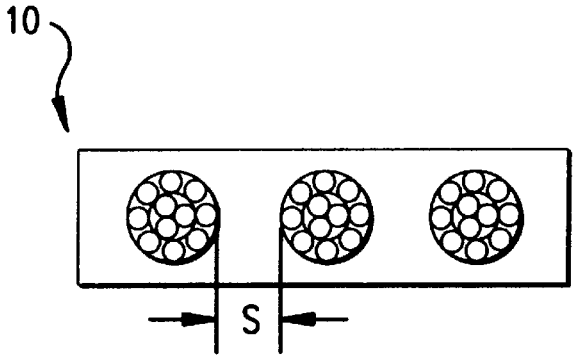
FIG. 15 is a sectional view of the carcass, showing the spacing between the steel cords.

For a breaking strength per 50-mm width of the composite, before formed into a tire, of a rubberized steel cord according to the present invention and a rubber, the diameter D of the steel cord is set as follows:

[(50 × Cord's breaking strength)/Composite's breaking strength − 1.1] ≦ D (diameter of steel cord in mm) ≦ [(50 × Cord's breaking strength)/Composite's breaking strength − 0.4]

for the spacing S (see FIG. 15) between the steel cords located near the tire beads 3 to fall in a range of 0.4 to 1.1 mm. This inter-cord spacing S improves the durability of the tire carcass.

More specifically, if the rubber between the generally parallel steel cords is less than 0.4 mm long, the shear stress in the rubber is too large in relation to the stress to which the carcass is subject when the tire rolls, with the result that the rubber between the steel cords is likely to crack and the steel cords and rubber are easily separable from each other. On the other hand, if the rubber length exceeds 1.1 mm, the inter-cord rubber is inflated as the tire is inflated with air. Thus the rubber is greatly burdened and heated very much when the tire rolls, causing the tire's high-speed capability to be lower.

The steel cord diameter D should more preferably be as follows:
[(50 × Cord's breaking strength)/Composite's breaking strength] − 0.9 ≦ D (mm) ≦ [(50 × Cord's breaking strength)/Composite's breaking strength − 0.6]

for the spacing S between the steel cords located near the tire beads 3 to be within a range of 0.6 to 0.9 mm.

The second embodiment of steel cord according to the present invention will be described herebelow:

This embodiment uses steel filaments each made of a carbon steel containing carbon in 0.8% by weight, having a diameter of 0.23 mm and a strength of 3,800N/mm$^2$. Three such steel filaments were spiraled with pitches of 6 mm for use as the core filaments while nine steel filaments were spiraled with pitches of 12 mm for use as the sheath filaments and wound on the circumference of the core. One such steel filament was further wound on the circumference of the sheath filaments to produce a steel cord having a "3+9+1" configuration. A twisting machine was used to manufacture the steel cord.

Assume here that the elastic limit of the steel filament is $\sigma_1$, such a stress as will yield no compressive plasticity in all the radial cross-sections of the spiraled steel filament is $\sigma_2$ and the maximum residual tensile stress in the surface layer inside the spiral of the steel filaments is $\sigma_3$ . To reduce the tensile stress residing longitudinally in the surface layer inside the spiral of the steel filaments resulting from untwisting the steel cord, the steel filaments are processed to meet the following relation:

$$\sigma_3+\sigma_2-\sigma_1>0$$

This processing will cause a portion of the steel filaments which fall in the range of $\sigma_3+\sigma_2-\sigma_1>0$ to be plastically deformed. This will be further described below in reference to FIGS. 16(A) through 16(C).

Figure 16A:
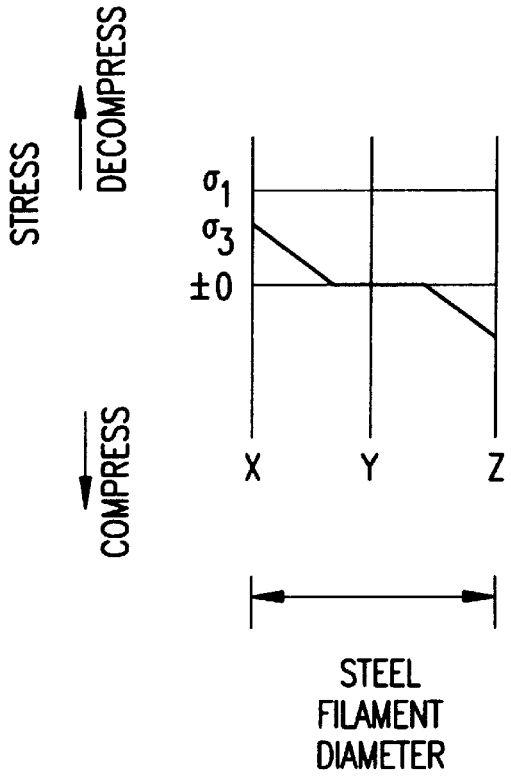
FIG. 16(A), 16(B) and 16(C) are schematic views showing the stress distribution in the radial cross-sections of the steel filaments in the steel cord.
Figure 16B:
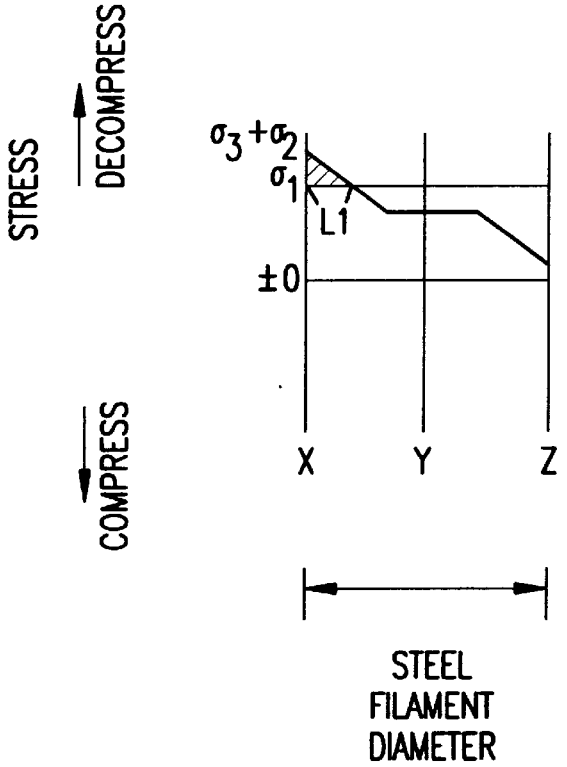
Figure 16C:
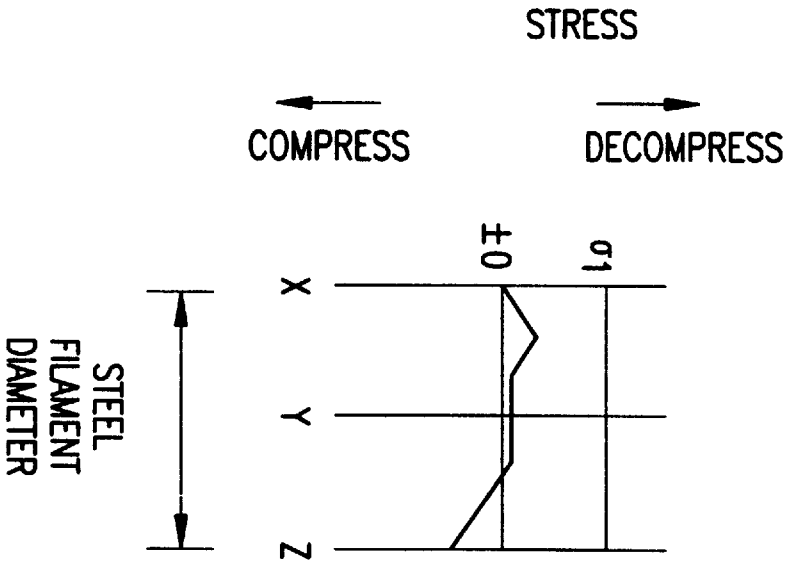

FIG. 16(A) is a stress distribution diagram schematically showing the residual stress yielded incidentally to the filament twisting but not the one incidental to the filament drawing for the convenience of explanation. The steel filaments resulting from untwisting the steel cord are spiraled. FIG. 16(A) shows the maximum residual tensile stress in the surface layer inside the spiral of the steel filaments. FIG. 16(B) shows a stress distribution which will be when the steel filament is given such a stress as will yield no compressive plasticity in all the radial cross-sections of the spiraled steel filament. In this Figure, the range of the steel filament from the surface to a depth L1 meets the relation $\sigma_3+\sigma_2-\sigma_1>0$. FIG. 16(C) shows a residual stress yielded after the stress $\sigma_2$ is removed from the steel filament. Note that the vertical and horizontal axes of these FIGS. 16(A) through 16(C) show the stress and steel filament diameter, respectively. The characters X, Y and Z show the stresses inside, along and outside the axis, respectively, of the spiraled steel filament.

Figure 17:
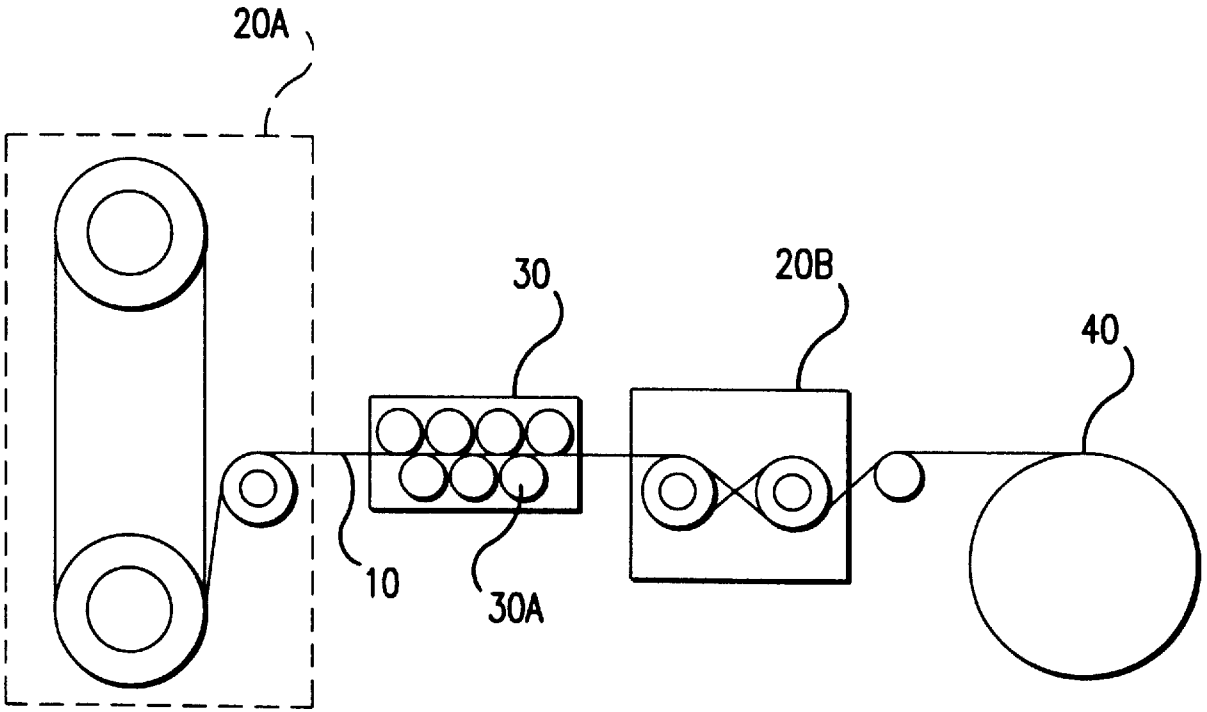
FIG. 17 shows essential components of a steel cord manufacturing system according to the present invention.

Also the residual stress distribution inside the axis of the spiraled steel filaments 10A forming together the steel cord was determined by calculation Next, a steel cord manufacturing system as shown in FIG. 17 was used for processing the steel cord to meet the relation $\sigma_3+\sigma_2-\sigma_1>0$, there by reducing the maximum residual tensile stress in a portion of the spiraled steel filament 10A ranging from the surface layer inside the spiral to the required depth thereof.

The system shown in FIG. 17 comprises tensioners 20A and 20B to tension the steel cord 10. The tensioners 20A and 20B are designed to freely set a tension. Further the system comprises a bending post 30 composed of a plurality of staggered rollers 30A to bend the steel cord 10 and which is designed to freely adjust the amount of bending the steel cord 10. The system also comprises a winder to take up the steel cord 10. The tension of the steel cord 10 extending between the tensioners 20A and 20B can be freely adjusted by means of the tensioners 20A The bender 30 is provided to enable the bending only in the elastic phase by adjustment for such a roll diameter and depth of engagement as will cause no plastic deformation of the steel cord 10 being not tensioned. For this adjustment, the steel cord 10 was applied with a tension of 1,000N/mm$^2$ (in the embodiment R), 1,300N/mm$^2$ (in the embodiment S) and 1,600N/mm$^2$ (in the embodiment T) to reduce the residual stress in a portion of the steel filament ranging from the surface to a desired depth thereof until the relation a, $\sigma_3+\sigma_2-\sigma_1>0$ is met.

For the purpose of comparison, the drawn steel cord was repeatedly bent to reduce the residual tensile stress in the surface layer of the steel filaments, and then twisted (in the comparative example 4). Furthermore, the steel cord 10 thus formed was given a tension of 500N/mm$^2$ by the tensioners 20A and 20B to reduce the residual tension stress inside the spiral of the steel filaments 10A, and then given a residual compressive stress to outside but not to inside the spiral of the steel cord 10 by adjusting the bending between the rollers in the bending post 30 (in the comparative example 5).

The three types of steel cords 10 according to the embodiments R through T and two types of steel cords in the comparative examples 4 and 5 were used to make carcass plies (number of encased steel cords: 30.28 cords/5 cm), respectively. These carcass plies were used to make five types of pneumatic radial-ply tires (size: 11R2.5-14 PR).

Each of the steel cords 10 was untwisted into spiraled steel filaments 10A. Of the steel filaments 10, the sheath filament 10A' was cut to a length of 100 mm, enameled longitudinally and semi-circumferentially thereof, and then immersed in a 50% aqueous nitric acid. When the half-circumference of the sheath filament 10A' not enameled has dissolved to a predetermined thickness, the continuous movement of the sheath filament 10A' was measured. Both the change in radius of curvature when the portion inside the spiral of the sheath filament 10A' dissolved and the movement of the entire 100 mm-long sheath filament, were measured. The measured changes in radius of curvature are as shown in FIGS. 4 and 5 for the previously mentioned first embodiment of the present invention. The measured movement of the entire sheath filament are shown in FIG. 18. In this Figure, the movement in the direction of arrow P is taken as negative-going value while that in the direction of arrow Q is taken as positive-going value.

For evaluation of the resistance to corrosion fatigue, the steel cord in the tire was cut to a length of 100 mm. This piece of steel cord was immersed in a neutral solution containing nitric and sulfuric ions in small amounts. A rotary bending-fatigue testing machine (not shown) was used to revolve the steel cord 10 at a speed of 1,000 rpm min while the steel cord 10 being revolved was applied with a repetitive bending stress of 300N/mm$^{2.}$ The speed of revolution at which the steel filaments 10A in the steel cord 10 was broken up was recorded. The results of this test are shown in Table 4. In Table 4, the speed of revolution at which the steel cord in the comparative example 4 was broken is taken as 100. Table 4 indicates exponentially such speed of revolution. A larger figure means a better corrosion-fatigue resistance of the steel cord.

Note that the steel cord 10 in the comparative example 4 is a one once drawn, then repeatedly bent to reduce the residual tensile stress in the surface layer of the straight steel filaments, and thereafter twisted. As evident from Table 4, the twisting applied to the steel filaments at the final step spoiled the reduction once attained of the residual tensile stress. As mentioned above, the steel cord 10 once formed in the comparative example 5 was given a tension of 500N/mm$^2$ by the tensioners 20A and 20B to reduce the residual tension stress inside the spiral of the steel filaments 10A, and then given a residual compressive stress to the entire circumference of the steel cord 10 by adjusting the bending through between the rollers 30A in the bending post 30. The movement of the entire steel filament 10A of 100 mm in length means that the residual stress serves to compress the steel filaments but the residual tensile stress inside the axis of the spiraled steel filaments 10A is not reduced.

The measured changes in radius of spiral curvature of the steel filaments of which the surface layer inside the spiral was dissolved as well as the measured movement of the entire 100 mm-long steel filament were same as those of both the core and sheath filaments.

TABLE 4

| | Comparative example 4 | Comparative example 5 | Embodiment R | Embodiment S | Embodiment T |
|---|---|---|---|---|---|
| Curvature change at depth equivalent to 3% of filam ent diameter from cord surface (%) | 100 | 103 | 96 | 92 | 90 |
| Curvature change at depth equivalent to 5% of filament diameter from cord surface (%) | 103 | 103 | 92 | 86 | 92 |
| Curvature change at depth equivalent to 10% of filament diameter from cord surface (%) | 103 | 110 | 103 | 95 | 88 |
| Movement of end of entire 100 mm-long filament (%) | −4 | −45 | +7 | −32 | −50 |
| Exponent of corrosion-fatigue resistance (steel cord) | 100 | 100 | 116 | 164 | 189 |
| Exponent of corrosion-fatigue resistance (tire) | 100 | 99 | 115 | 162 | 179 |
| Residual stress inside spiral($N/mm^2$) *1 | 1830 | 1850 | 350 | 90 | −300 |

*1: Change in curvature at a depth equivalent to 10% of filament diameter from cord surface was calculated as residual stress.

Conventionally, the steel cord 10 twisted by a tubular twisting device is tensioned while being passed through between the straightening rollers. According to the present invention, however, the steel filaments 10A resulting from untwisting the steel cord 10 are given such a tension as results in an $R_1/R_0$ ratio ×100 which is less than 100 ($R_0$: Radius of spiral curvature, as in FIG. 4, of the spiraled steel filament 10A; $R_1$: Radius of spiral curvature, as in FIG. 5, of the steel filament 10A of which the surface layer inside the spiral is removed by dissolving).

To reduce the residual tensile stress inside the spiral of the steel filaments 10A forming together the steel cord 10 having a "3+9×0.21 mm" configuration, for example, the steel cord 10 was applied with a tension of 500N/$mm^2$. Also, a buncher twisting machine can be used to reduce the residual tensile stress inside the spiral of the steel filaments 10A-by making the tension with which the straight steel filaments are twisted together, larger than that with which the steel filaments are untwisted by a turbine. In this case, the residual tensile stress inside the spiral of the steel filaments 10A can be reduced without tensioning the steel filaments being passed through between the straightening rollers as in the tubular twisting machine. For evaluation of the corrosion-fatigue resistance, the following preparation was made. Before fitting the tire under test to the rim of a wheel, a tire tube was placed inside the inner liner of the tire, and 300 ml of water was put as sealed between the inner liner and tube. The tire was driven to roll on a testing drum until the carcass cord was broken up (CBU). Then the rolling or driving distance (tire's life) of the tire was measured.

In Table 4, the driving distance of the conventional tires (in the comparative example 4) is assumed to be 100. Therefore, the corrosion-fatigue resistance indicates exponentially the measured driving distance of the tire. A larger figure indicates a better resistance to corrosion fatigue of the tire. Note that the tire under test was applied with an internal pressure of 8 kg/$cm^2$ and a full (100%) load as stipulated in the Japanese Industrial Standard and that the tire was driven at a speed of 60 km/h.

As having been described in the foregoing, it is clear that the pneumatic tire using the steel cord 10 according to the present invention shows an improved durability as compared with the conventional ones. Although the embodiments of the present invention have been described concerning the application of the steel cord to the carcass 2 of pneumatic radial-ply tire, it will be apparent to those skilled in the art that the steel cord according to the present invention may be-used as encased in the belt 1, belt protective layer, side protective ply or reinforcing layers for the beads 3 of pneumatic radial-ply tires as well as in the)breaker and side reinforcing layer in a pneumatic bias-ply tires to improve the tire durability.

The steel cord according to this embodiment has the aforementioned structure. It is well known that increasing the strength of a steel filament will lower the corrosion-fatigue resistance of the filament. Our many experiments and experiences have lead us to find out the fact that the residual tensile stress in the surface layer inside the spiral of a heady-duty steel filament should be reduced to improve the resistance to corrosion fatigue of the steel filament.

As having previously been described, the carbon content in the steel cord for pneumatic tires is defined to be more than 0.7% by weight in the present invention because the strength of the steel filament 10A should exceed 3,000N/$mm^2$ for lighter tires.

Also, it has previously been described that the diameter of the steel filament 10A should be within a range of 0.10 to 0.40 mm since a filament diameter of less than 0.10 mm will lower the efficiency of drawing while the resistance to mechanical fatigue is low with a filament diameter of more than 0.40 mm.

Untwisting the twisted steel cord 10 results in a plurality of spiraled steel filaments 10A because the steel filaments are plastically deformed in the process of twisting straight steel filaments into a steel cord. Even if the residual tensile stress in the surface layer of the steel filament is reduced in the process of drawing, a maximum residual tensile stress takes place inside the spiral of the steel filament in the process of twisting, so that the inner portion of the steel filaments into which it is difficult to penetrate rubber deeply, namely, the portion inside the spiral of the steel filaments, is exposed to a corrosive environment and thus likely to be fatigued by the corrosion.

The present invention is intended to reduce the residual tensile stress in the surface layer inside the spiral of the steel filaments 10A in the process of twisting the steel filaments 10A into the steel cord 10. Therefore; the method of reducing the residual tensile stress in the surface layer of straight steel filaments in the process of drawing, as disclosed in the Japanese Unexamined Patent Publication No. (Heisei) 5-71084, may be adopted in combination with the present invention.

The tire fitted to the rim of vehicle wheel is repeatedly bent as the vehicle runs, so that the steel filaments 10A of the steel cord 10 frictionally abrade with each other (fretting) and thus are likely to be corroded. The residual tensile stress in a portion ranging from the surface of the steel filaments 10A to a depth equivalent to 5% of the filament diameter should preferably be reduced, and it is more preferable to reduce the residual tensile stress in a portion ranging from the surface of the steel filaments 10A to a depth equivalent to 10% of the filament diameter.

As having been described in the foregoing, the present invention reduces the residual tensile stress in the surface layer inside the spiral of the steel filaments 10A forming together a rubber product-reinforcing steel cord 10, thereby improving the corrosion-fatigue resistance of the steel cord 10 and thus greatly the durability of rubber products destined for use in corrosive environments. Further, the steel cord 10 according to the present invention is heavy-duty enough to lighten rubber products and improve the durability of them.

Also the present invention provides a two-layer or three-layer twisted steel cord 10 consisting of steel filaments 10A having a high tensile strength. Since the sheath filaments 10A' have a clearance defined between them, the residual tensile stress in the surface layer inside the spiral of the steel filaments 10A is reduced and no wrapping wire is provided on the steel cord 10, the steel cord 10 according to the present invention can show an improved retention of breaking strength and corrosion-fatigue resistance even after it is repeatedly bent. Therefore, vehicle tires reinforced with the steel cord 10 according to the present invention have an improved durability and a reduced weight which greatly contributes to an improved gas mileage of the vehicle using the tires. The present invention can provide a vehicle-use pneumatic tire which is extremely useful in saving the resources and protecting the natural environments.

Since the present invention reduces the residual tensile stress in the surface layer inside the spiral of the steel filaments 10A forming together the steel cord 10 for reinforcing a pneumatic tire, the steel cord 10 has an improved resistance to corrosion fatigue which greatly improves, when it is used in a pneumatic tire, the durability of the tire. Since the steel cord 10 according to the present invention is a heavy-duty thing, it can be used in a pneumatic tire which in turn will be lighter and have an improved durability.

In the foregoing, the steel cord 10 according to the present invention has been described concerning the applications to ti, but it will be apparent to those skilled in the art that the present invention is not limited to such applications and also applicable to a rubber crawler, etc.

What is claimed is:

1. A pneumatic tire having steel cord reinforcement which is corrosion resistant comprising:

a tire body including a steel cord structure formed of steel filaments twisted together to form spiraled steel filaments each having a spiral curvature:

said steel filaments having a filament diameter in a range of 0.10 to 0.40 mm and a tensile strength of more than 3,000N/mm$^2$, said steel filaments being pre-formed by drawing a wire rod having a carbon content of more than 0.70% by weight; and said steel filaments being processed to reduce residual surface tension such that said steel cord structure has an $R_1/R_0$ ratio ×100 which is less than 100, a value of said $R_1/R_2$ ratio ×100 being established by a test performed on a sample of said steel cord and in which $R_0$ is a radius of the spiral curvature of a one of said spiraled steel filaments which is removed from said steel cord structure in performing said test, and $R_1$ is a radius of a spiral curvature of said one of said spiraled steel filaments of which a surface layer inside the spiral curvature is removed by dissolving.

2. A pneumatic tire as set forth in claim 1, wherein said value of said $R_1/R_0$ ratio ×100 is based upon test removal of said surface layer in an amount ranging from a surface of said steel filament to a depth equivalent to 5% of the filament diameter.

3. A pneumatic tire as set forth in claim 1, wherein said value of said $R_1/R_0$ ratio ×100 is based upon test removal of said surface layer in an amount ranging from a surface of said steel filament to a depth equivalent to 10% of the filament diameter.

4. A pneumatic tire having steel cord reinforcement comprising:

a tire body including a steel cord formed of steel filaments twisted together to form spiraled steel filaments each having a spiral curvature:

the steel cord having one of:

an "M+N" two-layer configuration wherein a number M, ranging from 1 to 4, is a number of the steel filaments forming together a core of said steel cord and a number N. ranging from M+2 to M+5, is a number of the steel filaments forming a sheath of said steel cord; and an "M+N+P" three-layer configuration incorporating said "M+N" two-layer configuration and further comprising a number P, ranging from N+2 to N+5, of the steel filaments forming another sheath of said steel cord wound on an outer circumference of said sheath;

said steel filaments having a carbon content of more than 0.70% by weight, a diameter of 0.15 to 0.25 mm and a tensile strength ranging from 3,400 to 3,900 N/mm$^2$;

a mean value of spacings between adjacent steel filaments of said sheath and said another sheath being more than 0.02 mm and less than 1.5 times larger than the a filament diameter of said steel filaments;

said steel filaments of said sheath and said another sheath being preformed at a rate of 80 to 110% to yield a cord structure in which no wrapping wire is provided on an outer circumference of said steel cord; and said steel filaments being processed to reduce residual surface tension such that an $R_1/R_0$ ratio ×100 is less than 100, a value of said $R_1/R_0$ ratio ×100 being established by a test performed on a sample of said steel cord wherein $R_0$ is a radius of the spiral curvature of one of said spiraled steel filaments which is removed from said steel cord structure in performing said test, and $R_1$ is a radius of a spiral curvature of said one of said spiraled steel filaments of which a surface layer inside the spiral curvature is removed by dissolving.

5. A pneumatic tire as set forth in claim 4, wherein said tire body includes a carcass and said steel cord is in the carcass.

6. A pneumatic tire as set forth in claim 4, wherein said value of said $R_1/R_0$ ratio ×100 is based upon test removal of said surface layer in an amount ranging from a surface of said steel filament to a depth equivalent to 5% of the filament diameter.

7. A pneumatic tire as set forth in claim 4, wherein said value of said $R_1/R_0$ ratio ×100 is based upon test removal of said surface layer in an amount ranging from a surface of said steel filament to a depth equivalent to 10% of the filament diameter.

8. A pneumatic tire as set forth in claim 4, wherein said carbon content of said steel filaments is more than 0.70 to less than 0.85% by weight.

9. A pneumatic tire as set forth in claim 4, wherein a diameter D of said steel cord in millimeters meets the relation $$(50Y/X)-1.1 \leqq D \leqq (50Y/X)-0.4$$

where X is a breaking strength per 50-mm width of a composite ply of rubberized ones of said steel cord in rubber, before said composite is used in the pneumatic tire, Y is a breaking strength of said steel cord.

10. A pneumatic tire as set forth in claim 4, wherein a diameter D of said steel cord in millimeters meets the relation $$(50Y/X)-0.9 \leqq D \leqq (50Y/X)-0.6$$

where X is a breaking strength per 50-mm width of a composite ply of rubberized ones of said steel cord in rubber, before said composite is used in the pneumatic tire, and Y is a breaking strength of said steel cord.

* * * * *